United States Patent [19]

Chang

[11] Patent Number: 4,796,370

[45] Date of Patent: Jan. 10, 1989

[54] NUMERICAL DISPLAY MODULE

[76] Inventor: Kwangling Chang, 293 Kenilworth Avenue, Toronto, Ontario M4L 3S9, Canada

[21] Appl. No.: 44,301

[22] Filed: Apr. 30, 1987

[51] Int. Cl.[4] ..... G09F 3/04

[52] U.S. Cl. ..... 40/450; 40/470

[58] Field of Search ..... 40/447, 449, 450, 446, 40/463, 464, 466, 470, 473

[56] References Cited

U.S. PATENT DOCUMENTS

| | | | |
|---|---|---|---|
| 755,272 | 3/1904 | Burnham | 40/450 |
| 1,357,457 | 11/1920 | Jorgensen | 40/450 |
| 1,668,799 | 5/1928 | Bergan | 40/576 |
| 2,141,473 | 12/1938 | Hubertz | 40/447 |
| 3,273,270 | 9/1966 | Skrobisch | 40/450 |
| 3,990,165 | 11/1976 | Vogt | 40/447 |
| 4,024,532 | 5/1977 | Sherwin | 40/450 |
| 4,070,668 | 1/1978 | Kawaharada et al. | 40/450 |
| 4,223,464 | 9/1980 | Winrow | 40/450 |
| 4,470,213 | 9/1984 | Thompson | 40/473 |
| 4,486,820 | 12/1984 | Baba et al. | 362/183 |
| 4,496,945 | 1/1985 | Stadjuhar et al. | 40/450 |
| 4,542,603 | 9/1985 | Streeter et al. | 40/450 |
| 4,627,182 | 12/1986 | Weiss | 40/450 |
| 4,663,870 | 5/1987 | Bodet et al. | 40/447 |

FOREIGN PATENT DOCUMENTS

| | | | |
|---|---|---|---|
| 2707241 | 8/1978 | Fed. Rep. of Germany | 40/447 |

*Primary Examiner*—Robert Peshock
*Assistant Examiner*—Michael Lynch
*Attorney, Agent, or Firm*—David W. Wong

[57] ABSTRACT

The relatively large size seven-segmented numerical display module consists of six peripheral segments having the same shape and size. Each segment is operated by a transmission mechanical gear assembly and a low voltage direct current motor. Only a low energy solar cell and/or battery is required to operate all the segments so as to provide a selected numerical display.

3 Claims, 4 Drawing Sheets

NUMERICAL DISPLAY MODULE

BACKGROUND OF THE INVENTION

The present invention relates to a display device and particularly relates to a seven-segmented digital numerical display module.

Seven-segmented digital numerical display devices are well-known. In such device the numerals from 0 to 9 can be displayed by showing selected segments of the seven segments of the numerical figure "8". The operating mechanism of such device can be either electrical or electromechanical. In an electromechanical display device each segment of the seven segments of the numeral figure "8" is represented by an elongated blade mounted on a hinged arrangement such that the blade can be turned broad-sided with its front surface facing forwards to display the particular segment or turned sideways such that only its thin side edge is facing forwards so as not to show the segment. Commonly, complex electromechanical arrangements are required for selectively turning the seven segments in order to display a particular numeral. Furthermore, since such display sign is usually large in size in order that the numeral can be visible in a far distance, normally, the display blades must not be less than ten inches in length and two to four inches in width. To operate such large size component parts, complex mechanical operating system and high electrical power must be employed. Such high electrical power is difficult and costly to provide for the display sign since the latter is usually remotely mounted in a high up location, also it can present electrical hazards both to the installer and the operator. Moreover, the operating cost of such a system is high. Still furthermore, the high voltage electromechanical arrangement requires tedious maintenance to ensure its proper operation and hazard-free condition.

OBJECT OF THE INVENTION

The principal object of the present invention is to provide an electromechanical display device which requires extremely low electrical power to operate.

Another object of the present invention is to provide a display device in which each seven-segment numeral is in the form of a module. A selected number of such module can be easily installed side-by-side to display a series of figures of numerals.

Yet another object of the present invention is to provide a display device which is simple in structure and requires virtually no maintenance.

Another object of the present invention is to provide a seven-segment numerical display device in which the peripheral segments are of the same shape.

DETAILED DESCRIPTION OF THE INVENTION

Figure 3:
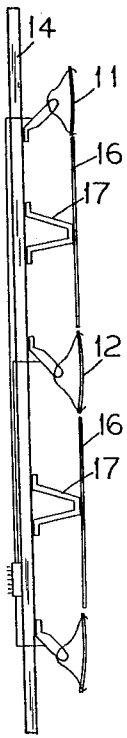
FIG. 3 is a cross sectional side elevation along the section line III—III of FIG. 2.
Figure 2:
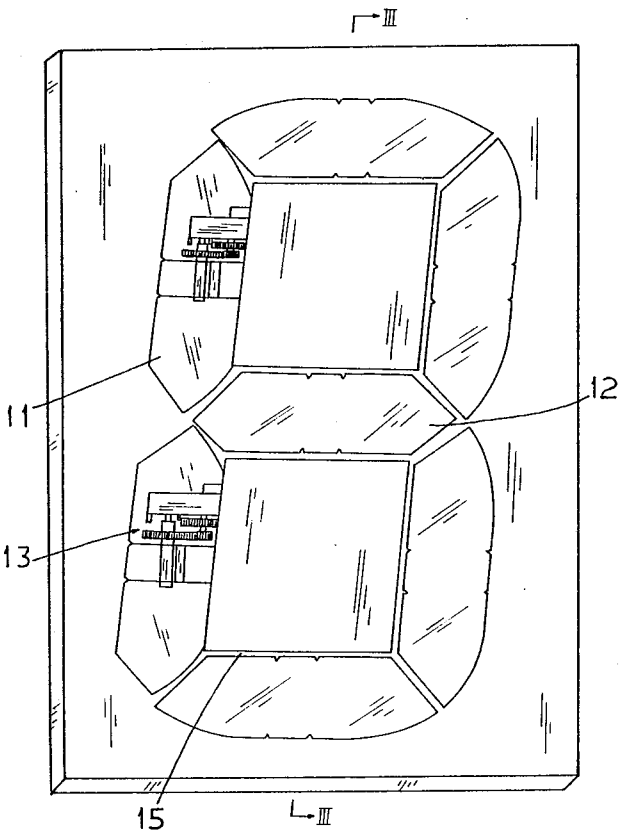
FIG. 2 is another perspective front view of the module thereof showing two segments of the display having turned backwards such that only five segments are visible so as to display a figure "3".
Figure 1:
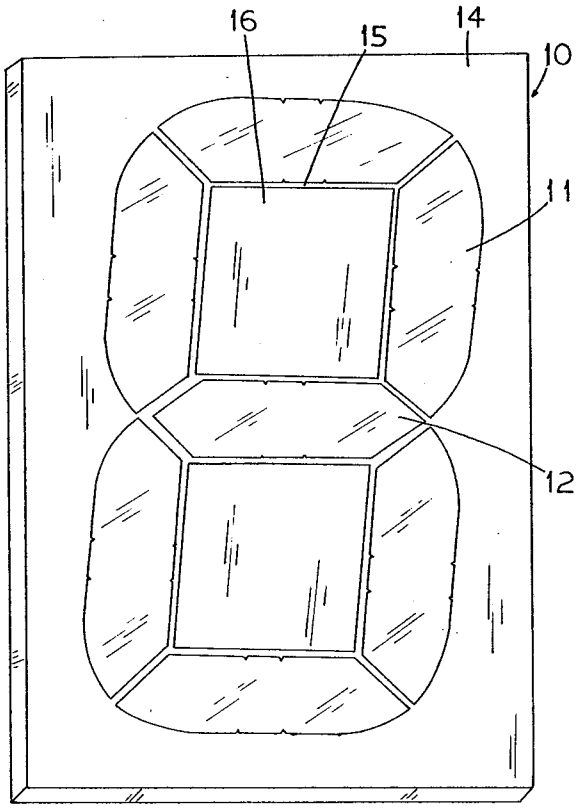
FIG. 1 is a perspective front view of a seven-segment numerical display module according to the present invention.

The preferred embodiment of the present invention is described below. In referring to the drawings, the same reference numerals will designate like elements throughout.

The display module according to the present invention is generally designated by the numeral 10. It contains a seven-segmented figure "8" represented by six peripheral segments 11 all of the same shape and size and a cross segment 12 having a slightly different shape than the peripheral segments 11. The cross segment 12 may have the same shape but it is preferrably have a more linear shape as shown in order to present a more pleasing appearance of the numerical figure in the display. Each segment has a blade operating assembly 13 mounted on a rectangular support board 14. The bounded rectangular areas 15 within the figure "8" are covered by two plates 16 which are mounted on the board 14 by inverted U-shaped spacer brackets 17 so that the plates 16 lie on approximatly the same plane as the display blades of the figure "8". The figure "8" is preferrably skewed at about 4 degrees from the vertical axis of the board so as to provide a further pleasing appearance.

Figure 4:
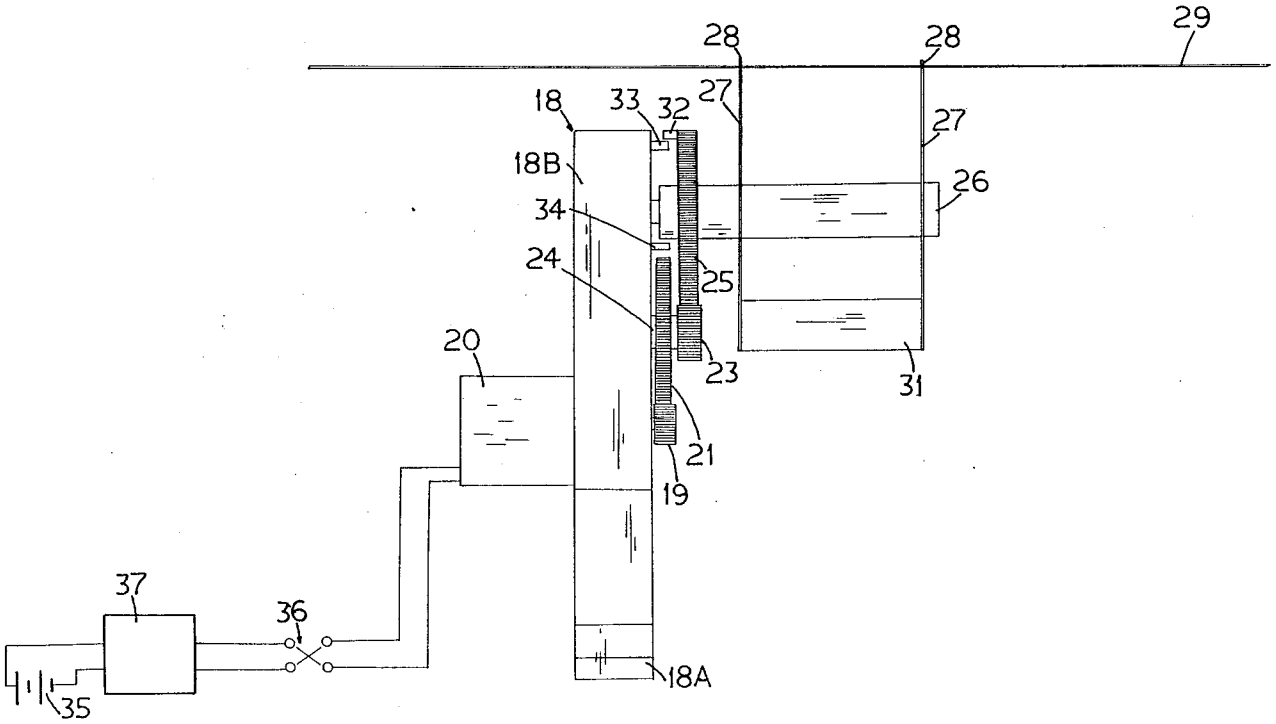
FIG. 4 is a partial schematic front elevation view of the blade operating assembly according to the present invention.
Figure 5:
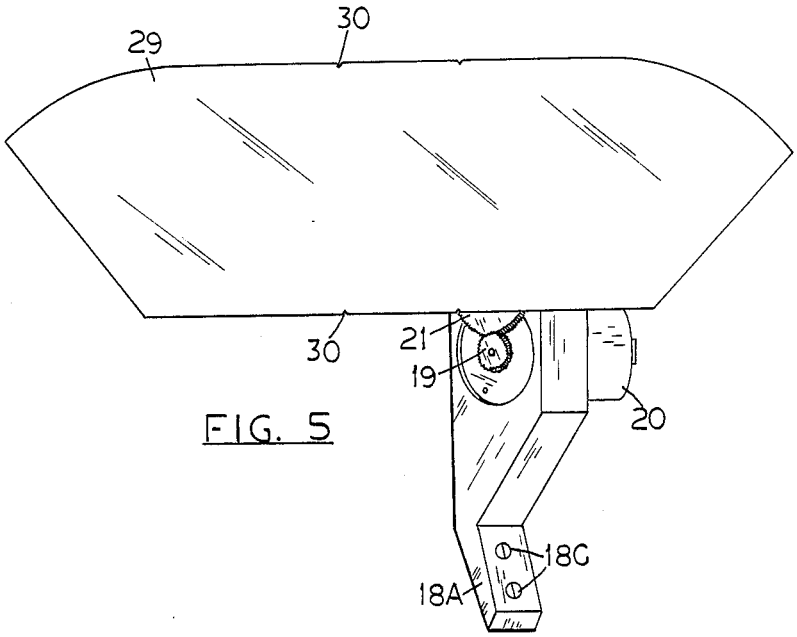
FIG. 5 is a front perspective elevation view of the blade operating assembly thereof with the front face of the display blade turned towards the front to show a segment.
Figure 6:
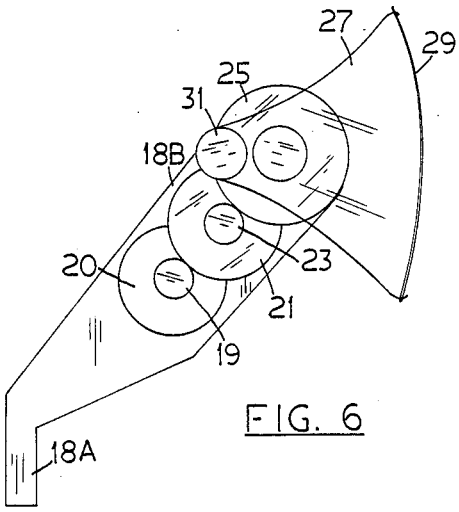
FIG. 6 is a side schematic elevation view of FIG. 5 showing the position of the display blade relative to the horizontal axis.
Figure 7:
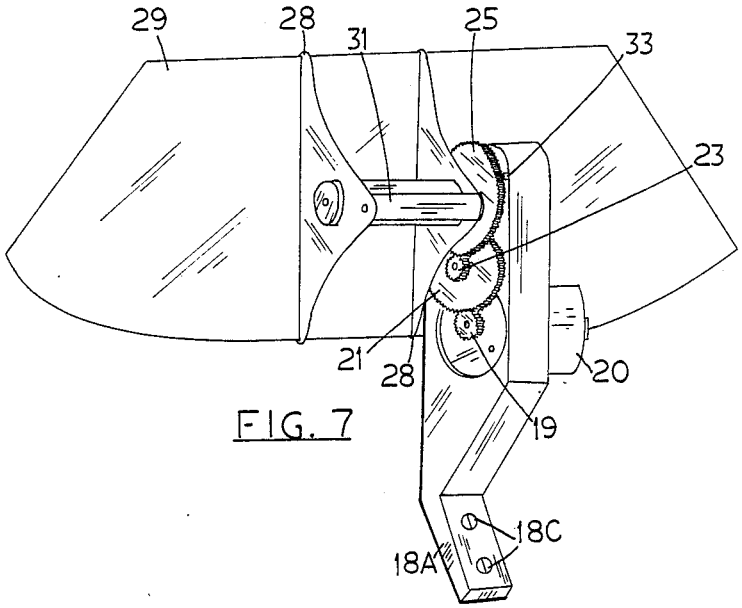
FIG. 7 is a front perspective elevation view of the blade operating assembly thereof with the display blade turned backwards at an angle so as to show the angled back side of the blade such that the segment is not visible.
Figure 8:
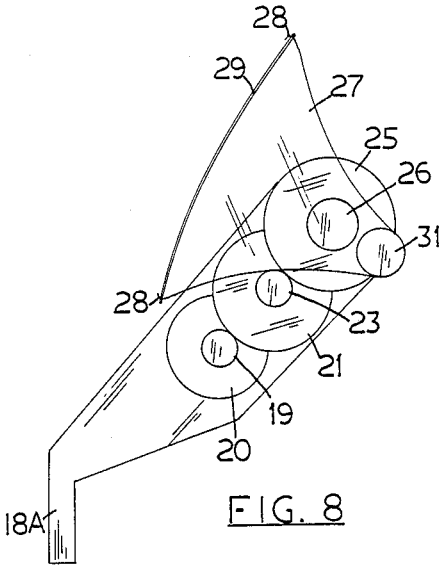
FIG. 8 is a schematic side elevation of FIG. 7 thereof showing the blade position in this condition.

As best shown in FIGS. 4, 5 and 7 each blade operating assembly 13 consists of a support block 18 having a base 18A and an upper portion 18B. The support block 18 is secured to the board 14 by screws 18C located at the base 18A such that the upper portion 18B extends at an angle of approximately 30 degrees relative to the surface of the board 14. An extra low voltage direct current motor 20 is mounted at the middle of the upper portion 18B of the support block 18. A drive gear 19 is provided at the motor shaft. The drive gear 19 engages with a first gear 21 of a transmission gear arrangement 22 which includes the first gear 21 and a co-axial second gear 23 mounted on a shaft 24. The second gear 23 engages with a rotary gear 25 mounted on a rotary shaft 26. The diameter of the drive gear 19 is equal to that of the second gear 23; and the diameter of the first gear 21 is about three times of that of the drive gear 19. While the diameter of the rotary gear 25 is about five times of that of the drive gear 19.

Two substantially triangular shaped blade carriers 27 are mounted on the rotary shaft 26. The blade carriers 27 are spaced from each other and have two hook shaped corners 28. The display blade 29 is made of a sheet material such as an aluminum alloy sheet having a slightly upwardly bowed shape cross section. Typically, the blade 29 is about three inches wide and about eleven inches long overall. Two pairs of shallow notches 30 are formed in the lateral edges of the display blade 29, so that the blade 29 can be removably mounted to the blade carriers 27 by snap-engagement of the notches 30 with the hook shaped corners of the blade carriers 27. A counter-balance weight 31 which may be in the form of a cylindrical metal weight is mounted at the third corner of the blade carriers 27 directly opposite to the display blade 29. The weight of the counter-balance weight 31 is substantially equal to that of the display blade 29 so that the load is evenly distributed between the two sides of the axis of the rotary shaft 26; accordingly, the rotary shaft 26 can be rotated with a very low electrical power and it will rotate with an even motion.

A pin 32 is provided at the edge portion in the inside surface of the rotary gear 25. Two abutments 33 and 34 are provided on the surface of the support block 18 facing the rotary gear 25. The pin 32 will rest against the abutment 33 when the display blade 29 is rotated with its front face facing forwards to show that segment of the figure "8". The pin 32 will rest against the abutment 34 when the display blade 29 has been rotated through about 135 to 150 degrees to blank out that segment of the figure "8".

The front face of the display blades 29 is painted white or other bright colour such as yellow or red or is painted with a reflective paint whereas the back of the blades 29 and all other parts including the support board 14, the plates 16, and the support block 18 as well as the gears are all painted black or a light absorbing dark colour so as to provide a distinct contrast between the visible front surface of the display segments of the figure "8" and the inconspicuous background.

A low direct current voltage source 35 such as a solar cell or a 1.25 volt battery is sufficient to operate the low current dc motor 20 of the blade operating assembly 13. A solar cell in parallel with a rechargeable type battery may be connected so that during daylight hours the operating voltage is mainly supplied by the solar cell which also maintains the battery fully charged all the time. After dark the battery provides the sole operating voltage. The voltage source 35 is connected to the dc motor 20 through a double-pole-double-throw momentary switch 36 which is operative to reverse the polarities of the power connections between the voltage source 35 and the dc motor 20 for selectively rotating the display blade 29 in one direction or in the opposite direction. Alternatively, a permanent double-pole-double-throw switch in combination with a pulsing circuit 37 may be used in place of the momentary switch. The pulsing circuit 37 directs the voltage supply to the dc motor 20 for a short period of time only, typically about 0.5 to 1 second, for just sufficient time to rotate the display blade 29 completely in one direction or in the opposit direction selectively.

In forming a particular number in the module 10, only one voltage source 35 is required for operating all seven segments of the figure "8". The power source 35 is connected in parallel to the seven double-pole-double-throw switches 36 of the seven segments. In operation, selected switches are operated one by one in sequence to obtain the desired display. Alternatively, a rotary type switch containing seven double-pole-double-throw switches in combination with a single momentary switch for controlling the power supply can be used to provide ten selected combinations of the seven segments so that each position setting of the rotary switch will represent a predetermined selected display from 0 to 9. To obtain a selected display in the latter construction, the desired number is first set with the rotary switch setting and then the momentary switch is pressed to execute the display It can be appreciated that due to the independent nature of the module 10. A selected number of modules 10 may be mounted together to provide a desired numerical display, and due to the simplicity of its construction the module 10 requires little or no maintenance. In case of any unforeseeable breakdown, an individual module may be quickly and easily replaced by another module.

I claim:

1. In a seven-segment numerical display module, each segment comprising a support block member directly mounted on a rectangular support board having a flat surface, said support block member having an upper portion extending at an acute angle above said flat surface, and said support block member having a side surface extending at a right angle to said flat surface of said support board, an extra low voltage direct current motor mounted in an opening formed in said upper portion of said support block member, and having a rotatable shaft extending perpendicular to said side surface of said support block member, a drive gear means directly mounted on said rotatable shaft of said direct current motor, said drive gear means having a predetermined diameter, a transmission gear means having a freely rotatable shaft directly mounted on said support block member, said transmission gear means having a first gear means rotatably engaged with said drive gear means, and said first gear means having a diameter substantially larger than the diameter of said drive gear means, and said transmission gear means having a second gear means mounted on said freely rotatable shaft and operatively rotatable with said first gear means, said second gear means having a diameter substantially smaller than the diameter of said first gear means, a second freely rotatable shaft directly mounted on said support block member, a rotary gear means mounted on said second freely rotatable shaft and rotatably engaged with said second gear means, said rotary gear means having a diameter substantially smaller than the diameter of said second gear means, a cylindrical member mounted on said freely rotatable shaft and operatively rotatable with said rotary gear means, two substantially triangular blade carrier means mounted on said cylindrical member, said triangular blade carrier means having two hook shaped corners, display blade member snap-mounted to said hook shaped corners of said blade carrier means, said display blade member being operative selectively to rotate relative to said cylindrical member to a first position wherein said display member is parallel to said flat surface of said board and to a second position wherein said display blade member is perpendicular to said flat surface of said board, a counterbalance weight mounted on said triangular blade carrier means and located at a third corner therein directly opposite to said display blade member, a pin member mounted on said rotary gear means, and a first abutment means and a second abutment means mounted on said upper portion of said support block member, said pin member operatively abutting said first abutment means when said display blade member is in said first position, and said pin member operatively abutting said second abutment means when said display blade member is in said second position.

2. A display module according to claim 1 wherein said direct current motor means is operative with a direct current voltage of not more than 1.5 volt.

3. A display module according to claim 1 wherein said direct current motor means is operative with a solar cell of not more than 1.5 volt.

* * * * *